US012578103B2

(12) United States Patent
Lee et al.

(10) Patent No.: US 12,578,103 B2
(45) Date of Patent: Mar. 17, 2026

(54) HUMIDIFIER FOR PREVENTING POLLUTION OF HUMIDIFYING WATER

(71) Applicant: SAMSUNG ELECTRONICS CO., LTD., Suwon-si (KR)

(72) Inventors: Sanghoon Lee, Suwon-si (KR); Changmin Seok, Suwon-si (KR); Seojeong Kim, Suwon-si (KR); Beomseok Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 382 days.

(21) Appl. No.: 18/241,568

(22) Filed: Sep. 1, 2023

(65) Prior Publication Data

US 2023/0408118 A1 Dec. 21, 2023

Related U.S. Application Data

(63) Continuation of application No. 17/124,917, filed on Dec. 17, 2020, now Pat. No. 11,767,994.

(30) Foreign Application Priority Data

Dec. 18, 2019 (KR) ..... 10-2019-0169726

(51) Int. Cl.
*F24F 6/04* (2006.01)
*F24F 6/00* (2006.01)
(Continued)

(52) U.S. Cl.
CPC ..... *F24F 6/04* (2013.01); *F24F 11/0008* (2013.01); *F24F 11/30* (2018.01); *F24F 13/28* (2013.01);
(Continued)

(58) Field of Classification Search
CPC ..... F24F 6/04; F24F 2006/046; F24F 11/30
See application file for complete search history.

(56) References Cited

U.S. PATENT DOCUMENTS 9,429,333 B2 8/2016 Yoon et al.
10,228,150 B2 3/2019 Lee et al.
(Continued)

FOREIGN PATENT DOCUMENTS

CN 201184878 Y 1/2009
CN 103512143 A 1/2014
(Continued)

OTHER PUBLICATIONS

JP2017072318A Translation (Year: 2017).*
(Continued)

*Primary Examiner* — Schyler S Sanks
(74) *Attorney, Agent, or Firm* — STAAS & HALSEY LLP

(57) ABSTRACT

The humidifier includes a humidifying member, a storage water tank, a circulating water tank, a residual water tank, a supply pump configured to supply water accommodated in the storage water tank to the circulating water tank, a circulating pump configured to supply water accommodated in the circulating water tank to the humidifying member. A fan configured to blow air toward the humidifying member and thereby cause water evaporated to be discharged outside the humidifier, an internal pipe configured to form a flow passage through which water not evaporated by the humidifying member is recovered to the circulating water tank, a drainage member configured to selectively discharge water accommodated in the circulating water tank to the residual water tank, and a controller configured to operate the humidifier in humidity mode based on the water level in the storage water tank.

6 Claims, 15 Drawing Sheets

(51) Int. Cl.

| | |
|---|---|
| ***F24F 11/00*** | (2018.01) |
| ***F24F 11/30*** | (2018.01) |
| ***F24F 13/28*** | (2006.01) |
| ***F24F 110/20*** | (2018.01) |

(52) U.S. Cl.
CPC ... *F24F 2006/006* (2013.01); *F24F 2006/008* (2013.01); *F24F 2006/046* (2013.01); *F24F 2110/20* (2018.01)

(56) References Cited

U.S. PATENT DOCUMENTS

| | | | | |
|---|---|---|---|---|
| 2002/0070465 | A1* | 6/2002 | Harvel ..... | F24F 6/04 261/36.1 |
| 2016/0348929 | A1 | 12/2016 | Lee et al. | |
| 2018/0100666 | A1 | 4/2018 | Park et al. | |
| 2018/0126313 | A1 | 5/2018 | Canonico et al. | |

FOREIGN PATENT DOCUMENTS

| | | | | |
|---|---|---|---|---|
| CN | 106369727 | A | | 2/2017 |
| JP | 2006-71145 | A | | 3/2006 |
| JP | 2007-139286 | | | 6/2007 |
| JP | 3928207 | | | 6/2007 |
| JP | 2008-232587 | A | | 10/2008 |
| JP | 2011-10702 | | | 1/2011 |
| JP | 2015-75248 | | | 4/2015 |
| JP | 2017-72318 | A | | 4/2017 |
| JP | 2017072318 | A | * | 4/2017 |
| JP | 6571480 | B2 | | 9/2019 |
| KR | 10-0803035 | | | 2/2008 |
| KR | 20-2009-0003849 | | | 4/2009 |
| KR | 20-0445336 | Y1 | | 7/2009 |
| KR | 20-0452696 | | | 3/2011 |
| KR | 10-2015-0094401 | | | 8/2015 |
| KR | 10-2016-0140328 | A | | 12/2016 |
| KR | 10-1749061 | | | 6/2017 |
| KR | 10-2018-0013323 | | | 2/2018 |
| KR | 10-2018-0014565 | | | 2/2018 |
| KR | 10-2018-0038155 | A | | 4/2018 |
| KR | 10-1893017 | | | 8/2018 |
| WO | WO 2014/185613 | A1 | | 11/2014 |

OTHER PUBLICATIONS

Chinese Office Action dated Mar. 1, 2025 issued by the Chinese Patent Office for Chinese Patent Application No. 202080088305.6.
International Search Report for International Patent Application No. PCT/KR2020/018431 dated Apr. 5, 2021.
Written Opinion for International Patent Application No. PCT/KR2020/018431 dated Apr. 5, 2021.
U.S. Office Action dated Oct. 7, 2022 for U.S. Appl. No. 17/124,917.
U.S. Office Action dated Dec. 13, 2022 for U.S. Appl. No. 17/124,917.
U.S. Notice of Allowance dated May 2, 2023 for U.S. Appl. No. 17/124,917.
U.S. Appl. No. 17/124,917, filed Dec. 17, 2020, Sanghoon Lee, Samsung Electronics Co., Ltd.
Korean Office Action dated Jun. 21, 2024 for Korean Application No. 10-2019-0169726.
Office Action dated Aug. 4, 2025 issued by the Chinese Patent Office for Chinese Patent Application No. 202080088305.6.

* cited by examiner

HUMIDIFIER FOR PREVENTING POLLUTION OF HUMIDIFYING WATER

CROSS-REFERENCE TO RELATED APPLICATIONS

This application is a continuation application of U.S. application number Ser. No. 17/124,917, filed on Dec. 17, 2020, which is based on and claims priority under 35 U.S.C. § 119(a) of a Korean patent application number 10-2019-0169726, filed on Dec. 18, 2019 in the Korean Intellectual Property Office, the disclosure of which is incorporated by reference herein in its entirety.

BACKGROUND

1. Field

The disclosure relates to a humidifier. More particularly, the disclosure relates to an evaporative humidifier.

2. Description of the Related Art

Types of humidifiers include a heating type that boils water with electricity to discharge it as steam, an ultrasonic type that vibrates water with ultrasonic waves to create water droplets, and a combined type that combines heating and ultrasonic types, and an evaporate type that naturally evaporates by blowing wind through a fan to a humidification device moistened with water.

Unlike the ultrasonic method, which has a disadvantage that various particles dissolved in water can be sprayed into the air together with water, the evaporation method has an advantage that sprayed moisture is relatively clean since it evaporates only pure water.

However, in the case of the conventional evaporative humidifier, since the water stored in the humidifier is continuously used, components dissolved in the water such as ionic components, organic substances, or the like, are concentrated, and microorganisms, or the like, are proliferated, and as a result of the water contamination, the humidifier may be incrusted with slime or may cause an odor.

In order to prevent this, the humidifier needs to be frequently cleaned, but users feel inconvenient to frequently perform cleaning the humidifier, and thus users do not perform cleaning often.

SUMMARY

The disclosure provides a humidifier that prevents pollution of a circulating water tank by automatically discharging water in the circulating water tank that supplies water to a humidifying member according to predetermined conditions.

The disclosure provides a humidifier that can maintain clean internal environment by performing purification of humidified water, sterilization treatment of humidified water, discharge of humidified water with concentrated foreign substances, or the like.

In particular, the disclosure discloses a specific control method of various components provided in the humidifier described above.

According to an embodiment of the disclosure, a humidifier includes a humidifying member, a storage water tank, a circulating water tank, a residual water tank, a supply pump configured to, based on an operating mode of the humidifier being humidity mode, supply water in the storage water tank to the circulating water tank, a circulating pump configured to supply water in the circulating water tank to the humidifying member, a fan configured to provide wind to the humidifying member to which the water is supplied, evaporate the water supplied to the humidifying member, and discharge the water to the outside of the humidifier, an internal pipe configured to form a flow pass through which water not evaporated in the humidifying member is returned to the circulating water tank, a drainage member configured to selectively discharge water in the circulating water tank to the residual water tank, and a controller configured to, based on a water level in the storage water tank being greater than or equal to a predetermined low water level, operate the humidifier in humidity mode, and based on the water level in the storage water tank being less than the predetermined low water level while the humidifier is operating in the humidify mode, stop the humidify mode based on at least one of a water level in the circulating water tank and a water level in the residual water tank.

According to an embodiment of the disclosure, a humidifier includes a humidifying member, a storage water tank, a circulating water tank, a residual water tank, a supply pump configured to, based on an operating mode of the humidifier being humidity mode, supply water in the storage water tank to the circulating water tank, a filter configured to purify water supplied from the storage water tank to the circulating water tank, a circulating pump configured to supply the water in the circulating water tank to the humidifying member, a fan configured to provide wind to the humidifying member to which the water is supplied, evaporate the water supplied to the humidifying member, and discharge the water to the outside of the humidifier, an internal pipe configured to form a flow pass through which water not evaporated in the humidifying member is returned to the circulating water tank, a drainage member configured to selectively discharge the water in the circulating water tank to the residual water tank, and a controller configured to, based on the water level in the circulating water tank being less than a predetermined low water level, control the supply pump such that water in the storage water tank is supplied to the circulating water tank through the filter, identify whether the filter needs to be replaced based on a time taken for the water level in the circulating water tank to reach a predetermine high water level, and provide a notification related to the replacement of the filter based on the identification result.

According to an embodiment of the disclosure, a humidifier includes a humidifying member, a storage water tank, a circulating water tank, a residual water tank, a sterilization treatment unit configured to sterilize water in the circulating water tank, a supply pump configured to, based on an operating mode of the humidifier being humidity mode, supply water in the storage water tank to the circulating water tank, a circulating pump configured to supply the water in the circulating water tank to the humidifying member, a fan configured to provide wind to the humidifying member to which the water is supplied, evaporate the water supplied to the humidifying member, and discharge the water to the outside of the humidifier, an internal pipe configured to form a flow pass through which water not evaporated in the humidifying member is returned to the circulating water tank, a drainage member configured to selectively discharge the water in the circulating water tank to the residual water tank, and a controller configured to, while an operating mode of the humidifier is in the humidity mode, based on a water level in the circulating water tank being greater than or equal to a predetermine high water level, control the sterilization treatment unit to sterilize the water in the circulating water tank, and control the circulating pump to supply the sterilized water to the humidifying member.

According to an embodiment of the disclosure, a humidifier includes a humidifying member, a storage water tank, a circulating water tank, a residual water tank, a supply pump configured to, based on an operating mode of the humidifier being humidity mode, supply water in the storage water tank to the circulating water tank, a circulating pump configured to supply the water in the circulating water tank to the humidifying member, a fan configured to provide wind to the humidifying member to which the water is supplied, evaporate the water supplied to the humidifying member, and discharge the water to the outside of the humidifier, an internal pipe configured to form a flow pass through which water not evaporated in the humidifying member is returned to the circulating water tank, a drainage member configured to selectively discharge water in the circulating water tank to the residual water tank, and a controller is configured to, based on a water level in the circulating water tank being identified to be less than the predetermined low water level while a water level in the storage water tank being greater than or equal to a predetermined low water level, control the supply pump to supply the water in the storage water tank to the circulating water tank such that the water level in the circulating water tank reaches a predetermined high water level, and based on the water level in the circulating water tank being identified to be less than the predetermined low water level while the water level in the storage water tank is less than the predetermined low water level, provide a notification related to replenishment of water, and wherein a volume of water corresponding to the predetermined low water level in the storage water tank is greater than or equal to a volume of water corresponding to the predetermined high water level in the circulating water tank.

According to an embodiment of the disclosure, a humidifier includes a humidifying member, a storage water tank, a circulating water tank, a residual water tank, a supply pump configured to, based on an operating mode of the humidifier being humidity mode, supply water in the storage water tank to the circulating water tank, a circulating pump configured to supply the water in the circulating water tank to the humidifying member, a fan configured to provide wind to the humidifying member to which the water is supplied, evaporate the water supplied to the humidifying member, and discharge the water to the outside of the humidifier, an internal pipe configured to form a flow pass through which water not evaporated in the humidifying member is returned to the circulating water tank, a drainage member configured to selectively discharge water in the circulating water tank to the residual water tank, and a controller configured to, based on the humidity mode being stopped, control the drainage member to discharge the water in the circulating water tank to the residual water tank.

The humidifier according to the disclosure includes a residual water tank, thereby preventing humidification by mixing the remaining water used for humidification with the water accommodated in the storage water tank, and increasing a cleaning interval of the humidifier by suppressing contamination of a humidifying member.

Also, the humidifier according to the disclosure provides optimal automatic control related to a start and stop of humidity mode on a structure using all of a storage water tank, a circulating water tank and a residual water tank.

DETAILED DESCRIPTION

Figure 1:
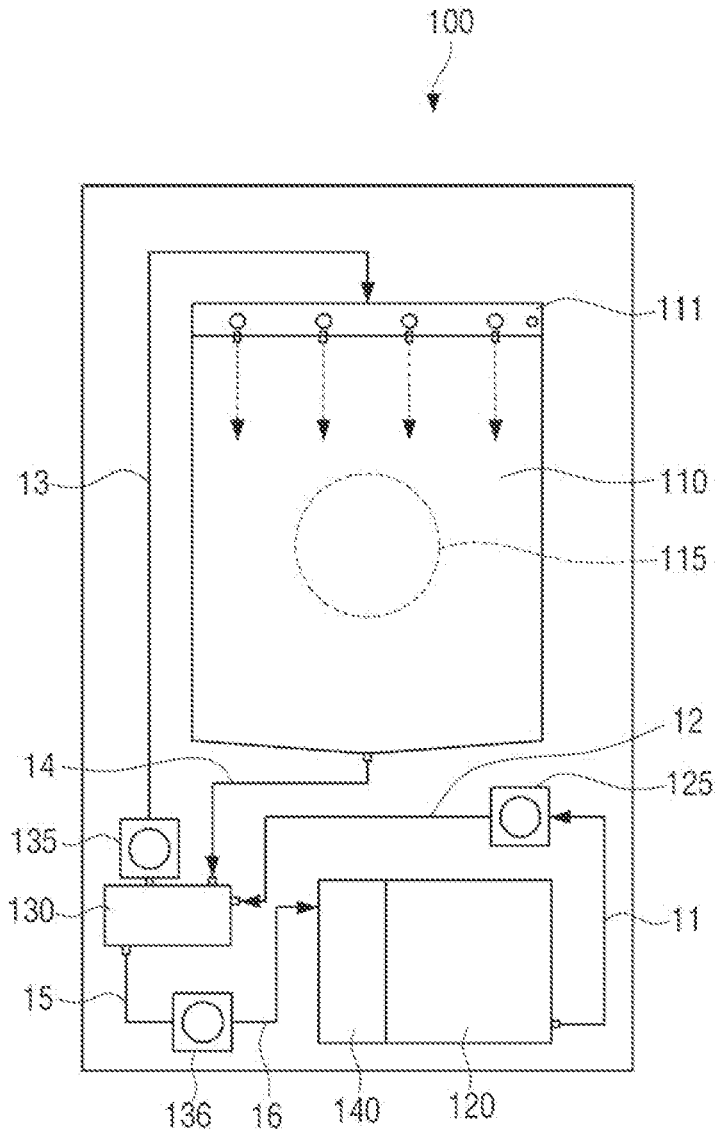
FIG. 1 is a view illustrating a configuration of a humidifier according to an embodiment of the disclosure.

Before specifically describing the disclosure, a method for demonstrating the disclosure and drawings will be described.

Terms used in the disclosure and claims were selected from general terms in consideration of functions in various embodiments of the disclosure. However, these terms may vary depending on the intention of those skilled in the art, legal or technical interpretation, and an emergence of new technologies. Also, there may be some terms arbitrarily selected by an applicant. Such terms may be construed according to meanings defined in the present specification, and may also be construed based on general contents of the present specification and a typical technical concept in the art unless the terms are not specifically defined.

Also, the same reference numerals or symbols described in the attached drawings denote parts or elements that actually perform the same functions. For convenience of descriptions and understanding, the same reference numerals or symbols are used and described in different exemplary embodiments. In other words, although elements having the same reference numerals are all illustrated in a plurality of drawings, the plurality of drawings do not mean one exemplary embodiment.

In addition, in order to distinguish between the components, terms including an ordinal number such as "first", "second", etc. may be used in the present specification and claims. The ordinal numbers are used in order to distinguish the same or similar elements from one another, and the use of the ordinal number should not be understood as limiting the meaning of the terms. For example, used orders, arrangement orders, or the like of elements that are combined with these ordinal numbers may not be limited by the numbers. The respective ordinal numbers are interchangeably used, if necessary.

The singular expression also includes the plural meaning as long as it does not differently mean in the context. The terms "include", "comprise", "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

In the exemplary embodiment of the present disclosure, the term "module," "unit," or "part" is referred to as an element that performs at least one function or operation, and may be implemented with hardware, software, or a combination of hardware and software. In addition, a plurality of "modules," a plurality of "units," a plurality of "parts" may be integrated into at least one module or chip except for a "module," a "unit," or a "part" which has to be implemented with specific hardware, and may be implemented with at least one processor (not shown).

Terms such as 'front', 'rear', 'upper', 'lower', 'upper part' and 'lower part' used in this disclosure are defined based on the drawings, and the shape and position of each component is not limited thereto.

Also, when any part is connected to another part, this includes a direct connection and an indirect connection through another medium. Further, when a certain portion includes a certain element, unless specified to the contrary, this means that another element may be additionally included, rather than precluding another element.

FIG. 1 is a view illustrating a configuration of a humidifier according to an embodiment of the disclosure.

Referring to FIG. 1, a humidifier 100 according to an embodiment of the disclosure may include a humidifying member 110, a storage water tank 120, a circulating water tank 130, and a residual water tank 140. In addition, the humidifier 100 may further include a fan 115, a supply pump 125, a circulating pump 135, and a drainage member 136, or the like.

The humidifying member 110 may include a humidifying element implemented in a structure in which water is absorbed and the absorbed water is easily evaporated. Specifically, water is sprayed to the humidifying member 110 from a distributor 111 shown in FIG. 1, and wind generated by a rotation of the fan 115 may be provided to the humidifying member 110. In this case, water sprayed on the humidifying member 110 may evaporate and be discharged to the outside of the humidifier 100.

The humidifying member 110 may be included in a humidifying member case. In this case, the humidifying member case may be detachable to the humidifier 100.

The storage water tank 120 is formed to accommodate a certain amount of water. The water in the storage water tank 120 may be water filled in the storage water tank 120 by a user. For this operation, the storage water tank 120 may be formed to be detachable to the humidifier 100.

Alternatively, the water in the storage water tank 120 may be water supplied from a separate external device connected to the storage water tank 120.

The circulating water tank 130 may be connected to the storage water tank 120 to receive water from the storage water tank 120.

Regarding the above, the supply pump 125 is a configuration for supplying the water accommodated in the storage water tank to the circulating water tank 130. Referring to FIG. 1, the storage water tank 110 and the supply pump 125 may be connected by a pipe 11, and the supply pump 125 and the circulating water tank 120 may be connected by a pipe 12.

The circulating pump 135 is a configuration for supplying water accommodated in the circulating water tank 130 to the humidifying member 110. The circulating pump 135 and the humidifying member 110 (and/or the distributor 111) may be connected through a pipe 13.

Specifically, the water accommodated in the circulating water tank 130 may be provided to the distributor 111 by the circulating pump 135, and the distributor 111 may supply the provided water to the humidifying member 110.

Referring to FIG. 1, the humidifier 100 may include an internal pipe 14 that forms a flow passage through which water not vaporized in the humidifying member is recovered to the circulating water tank 130. In other words, some of the water supplied from the circulating water tank 130 to the humidifying member 110 may be recovered to the circulating water tank 130.

The residual water tank 140 is a tank for accommodating discharged residual water when residual water remaining in the circulating water tank 130 is discharged. The water accommodated in the residual water tank 140 may be thrown out by the user. For this operation, the residual water tank 140 may be formed to be detachably attached to the humidifier 100.

Regarding the above, the drainage member 136 may selectively discharge water accommodated in the circulating water tank to the residual water tank. The drainage member 136 may be implemented as a valve controlled by simply opening/closing, a pump that moves water based on power, or the like.

The circulating water tank 130 and the drainage member 136 may be connected through a pipe 15, and the drainage member 136 and the residual water tank 140 may be connected through a pipe 16.

Figure 2:
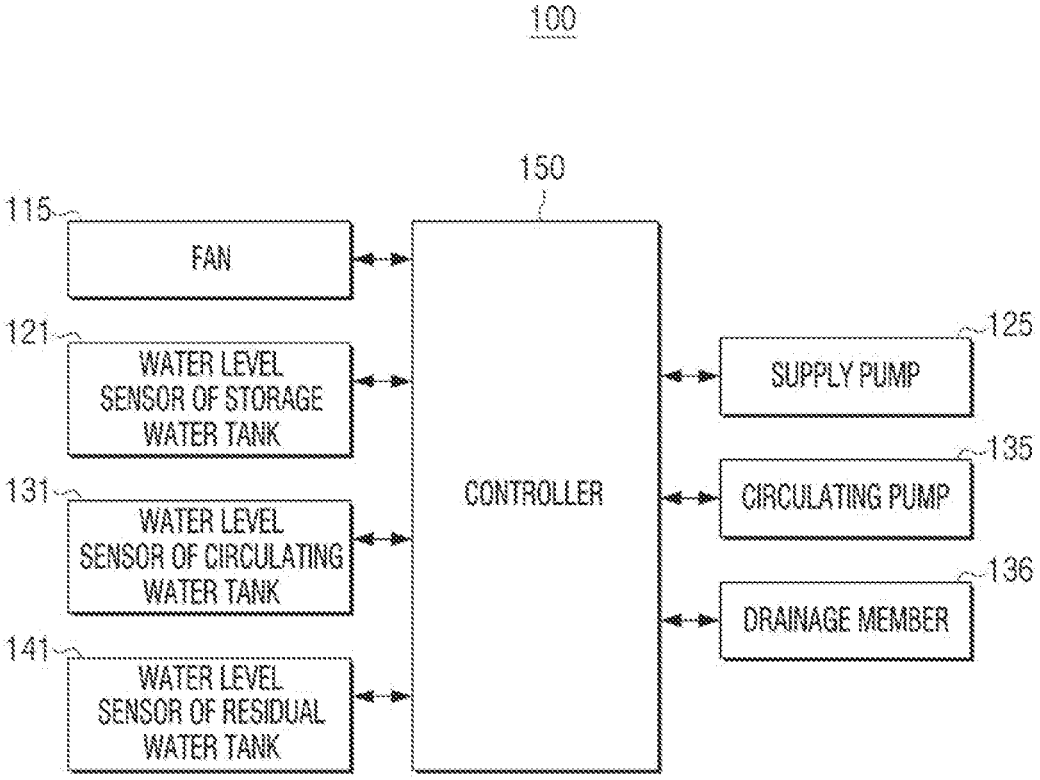
FIG. 2 is a block diagram illustrating a functional configuration of a humidifier according to an embodiment of the disclosure.

FIG. 2 is a block diagram illustrating a functional configuration of a humidifier according to an embodiment of the disclosure.

Referring to FIG. 2, the humidifier 100 may include a water level sensor 121 for measuring a water level in the storage water tank, a water level sensor 131 for measuring a water level in the circulating water tank, and a water level sensor for measuring a water level in the residual water tank 141.

Each of the sensors 121, 131, and 141 described above may be implemented with various types of sensors for measuring the water level in the tanks. As an example, each of the water level sensors 121, 131 and 141 may include a low water level sensor and a high water level sensor, but is not limited thereto.

In addition, referring to FIG. 2, the humidifier 100 may include a controller 150 for controlling various configurations of the humidifier 100.

The controller 150 may control the operation of the humidifier 100 based on at least one of whether at least one of the humidifying member 110, the storage water tank 120, and the residual water tank 130 is attached or detached, and the water level in water tanks 120, 130 measured through the water level sensors 121, 131, and 141.

For this operation, the controller 150 may include a circuit directly/indirectly connected to the water level sensors 121, 131, 141, the supply pump 125, the circulating pump 135, the drainage member 136, or the like. In addition, the controller 150 may include at least one processor and a memory.

The controller 150 may set/control an operating mode of the humidifier 100. The operating mode may include a humidity mode (i.e., performing a humidifying operation), a non-humidity mode (i.e., not performing a humidifying operation), or the like. When the humidifier 100 is a humidified air cleaning device including an air cleaning function in addition to the humidifying function, the non-humidity mode may be an air cleaning mode.

When the operating mode of the humidifier 100 is humidity mode, the controller 150 may control components of the humidifier 100 to perform various operations for humidification.

Figure 3:
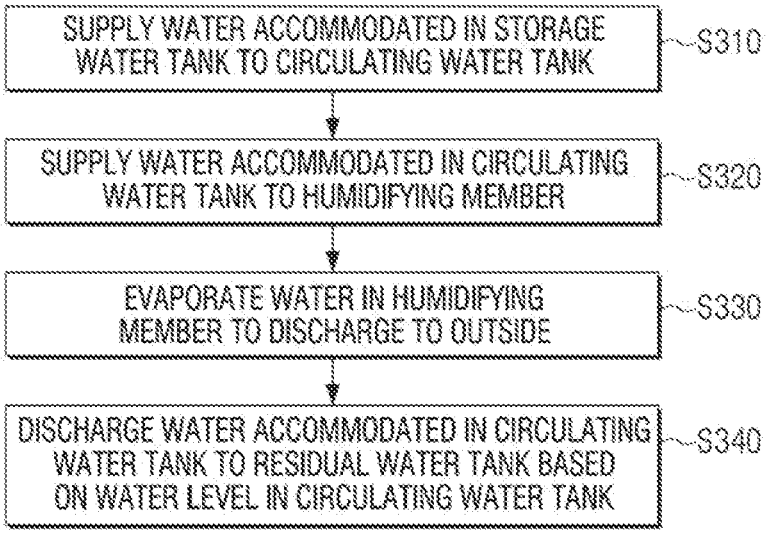
FIG. 3 is a flowchart illustrating an operation in humidity mode of a humidifier according to an embodiment of the disclosure.

FIG. 3 is a flowchart illustrating an operation of a humidifier operating in the humidity mode.

Referring to FIG. 3, when the operating mode of the humidifier 100 is the humidity mode, the controller 150 may control the supply pump 125 to supply water accommodated in the storage water tank 120 to the circulating water tank 130 (S310).

In addition, the controller 150 may control the circulating pump 135 to supply water accommodated in the circulating water tank 130 to the humidifying member 110 (S320). Specifically, when the water level in the circulating water tank 130 is less than a predetermined low water level, the controller 150 may control the supply pump 125 to supply the water accommodated in the storage water tank 120 to the circulating water tank 130 such that the water level in the circulating water tank 130 reaches a predetermined high water level.

The controller 150 may drive the fan 115 to evaporate water in the humidifying member 110 to discharge it to the outside (S330). In this case, water supplied to the humidifying member 110 but not vaporized may be returned to the circulating water tank 130 through the internal pipe 14. However, in this case, a concentration of foreign substances/microorganisms of water supplied to the humidifying member 110 but not vaporized may become more than before being supplied to the humidifying member 110.

In this case, the controller 150 may control the drainage member 136 to discharge the water accommodated in the circulating water tank 130 to the residual water tank 140 based on the water level in the circulating water tank 130 (S340).

Specifically, when the water level in the circulating water tank 130 has reached a predetermined high water level as a result of supplying the water accommodated in the storage water tank 120 to the circulating water tank 130, and the water accommodated in the circulating water tank 130 has reached a predetermined low water level as a result of supplying the accommodated water in the humidifying member 110.

Alternatively, when the number of times the supply pump 125 supplies water to the circulating water tank 130 is a predetermined number of times such that the water level in the circulating water tank 130 reaches the predetermined high water level from below the predetermined low water level, and if the water level in the circulating water tank 130 becomes less than the predetermined low water level, the controller 150 may control the drainage member 136 to discharge the water in the circulating water tank 130 to the residual water tank 140.

Figure 4:
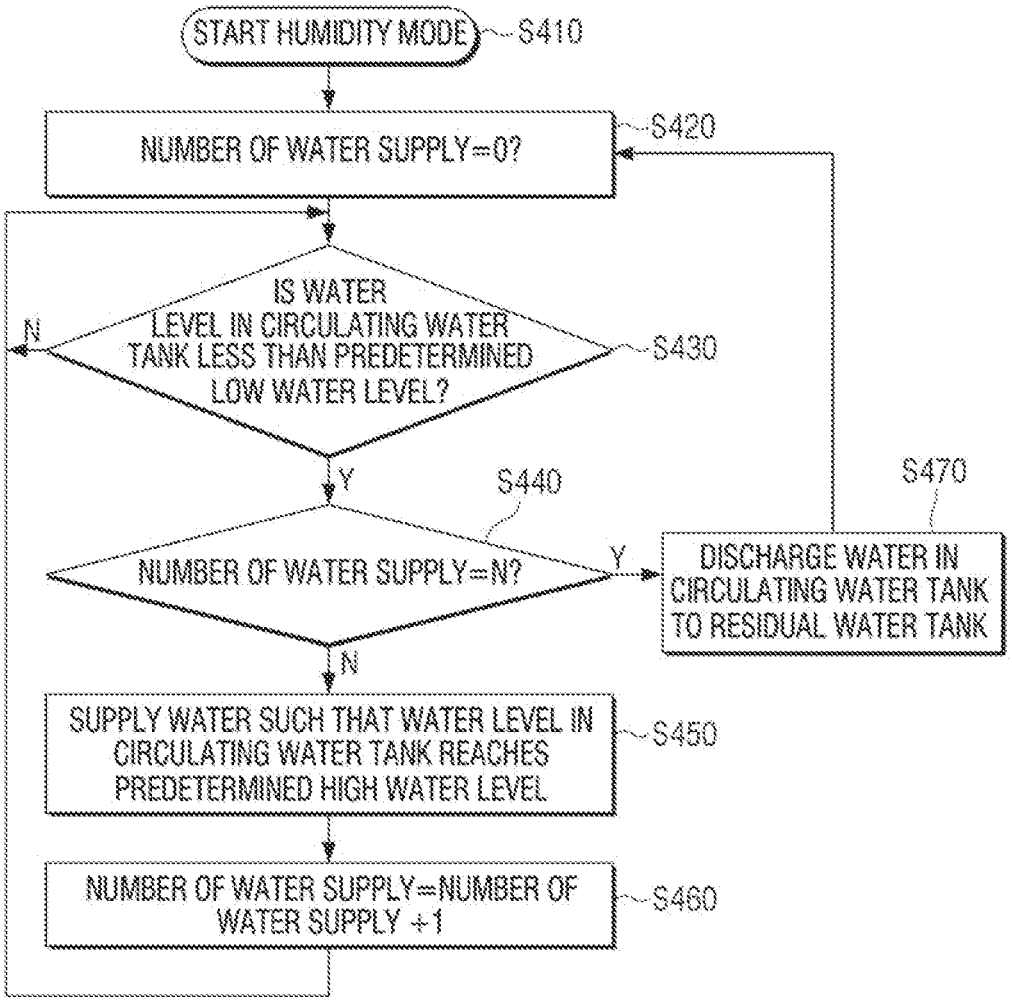
FIG. 4 is an algorithm illustrating an example of an operation of a humidifier for discharging water accommodated in a circulating water tank to a residual water tank.

FIG. 4 is an algorithm illustrating a specific example of the operation of a humidifier for discharging water accommodated in a circulating water tank to a residual water tank.

Referring to FIG. 4, after the humidity mode is started (S410), a water level in the circulating water tank 130 may be measured in real time in a state in which the number of water supply=0 (S420).

When the water level in the circulating water tank 130 is less than the predetermined low water level (S430—Y), the operation of the controller 150 may vary depending on whether the number of water supply is N (: predetermined number) times.

If the water level in the circulating water tank 130 is less than the predetermined low water level (S430—Y), and the number of water supply is not N times (S440—N), the controller 150 may control the supply pump 125 such that the water level in the circulating water tank 130 reaches the predetermined high water level (S450). When the supply is finished, the number of water supply may be increased by one (S460).

Meanwhile, when the water level in the circulating water tank 130 is less than the predetermined low water level (S430—Y), the number of water supply is N times (S440—Y), the controller 150 may control the drainage member 136 to discharge the accommodated water to the residual water tank 140 (S470). In this case, the stored number of water supply may be 0 again (S420).

According to the embodiments described above that selectively discharging residual water in the circulating water tank 130, a situation in which residual water enriched with microorganisms/bacteria may be stored for a long period of time in the circulating water tank 130 and left unattended may be automatically prevented.

Meanwhile, the controller 150 may operate the humidifier 100 in the humidity mode described above when the water level in the storage water tank 120 is more than the predetermined low water level. Specifically, the controller 150 may start the humidity mode only when the humidifying member case is attached to the humidifier 100 and the water level in the storage water tank 120 is equal to or more than the predetermined low water level.

If a user command to start the humidifying operation is input while the water level in the storage water tank 120 is less than the predetermined low water level, the controller 150 may provide a notification of water shortage.

Meanwhile, when the humidity mode starts, the controller 150 may control the drainage member 136 to discharge the water in the circulating water tank 130 to the residual water tank 140, and when the discharge ends, the controller 150 may control the supply pump 125 to supply water to the circulating water tank 130 from the storage water tank 120. In this case, there is an advantage in that it may be possible to discard the residual water remaining in the existing circulating water tank 130 and use more clean water.

Meanwhile, when the water level in the storage water tank is less than the predetermined low water level in a state in which the humidifier 100 is operated in the humidity mode, the controller 150 may stop the humidity mode based on at least one of the water level in the circulation water tank 130 and the water level in the residual water tank 140.

Figure 5:
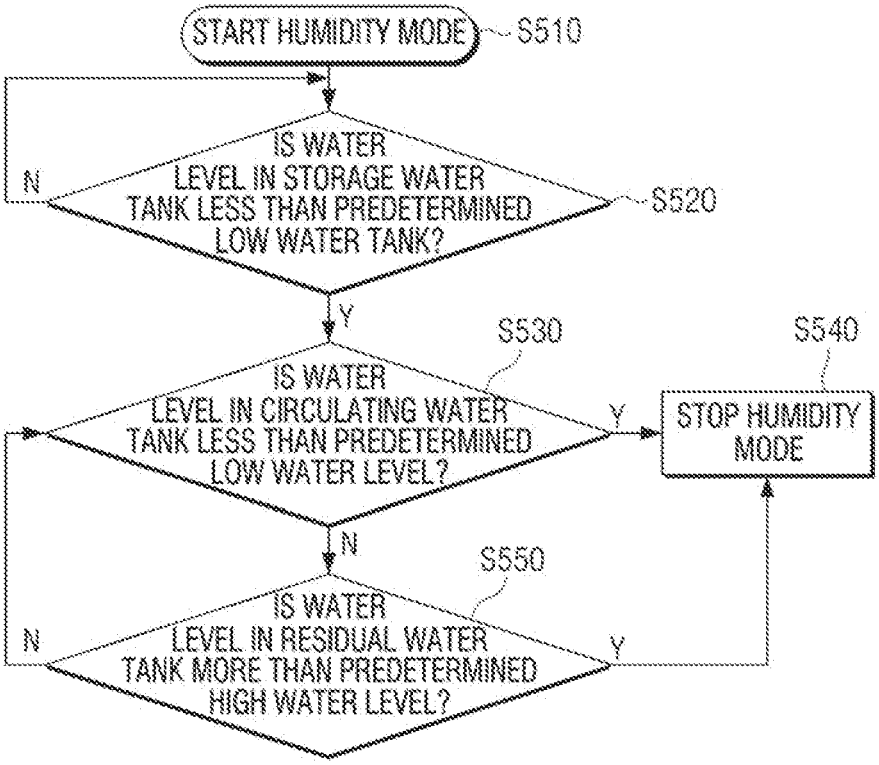
FIG. 5 is an algorithm illustrating an example of an operation of a humidifier for stopping humidity mode depending on a condition.

FIG. 5 is an algorithm illustrating an example of an operation of a humidifier for stopping humidity mode depending on conditions.

Referring to FIG. 5, after the humidity mode is started (S510), the controller 150 may identify whether the water level in the storage water tank 120 is less than a predetermined low water level based on sensing data of the storage water level sensor 121 (S520).

When the water level in the circulating water tank 130 is less than the predetermined low water level (S530—Y), while the water level in the storage water tank 120 is less than the predetermined low water level (S520—Y), the controller 150 may stop the humidity mode (S540). Meanwhile, the predetermined low water level in S520 may refer to a target different from the predetermined low water level in S530, and each may be independently predetermined from each other.

When the water level in the circulating water tank 130 is not less than the predetermined low water level (S530—N), but the water level in the residual water tank 140 is more than the predetermined high water level (S550—Y), while the water level in the storage water tank 120 is less than the predetermined low water level (S520—Y), the controller 150 may stop the humidity mode (S540).

In other words, when the circulation water tank 130 is less than the predetermined low water level or the residual water tank 140 is more than the predetermined high water level, while the water level in the storage water tank 129 is less than the predetermined water level, the controller may stop the humidity mode (S540).

Figure 6:
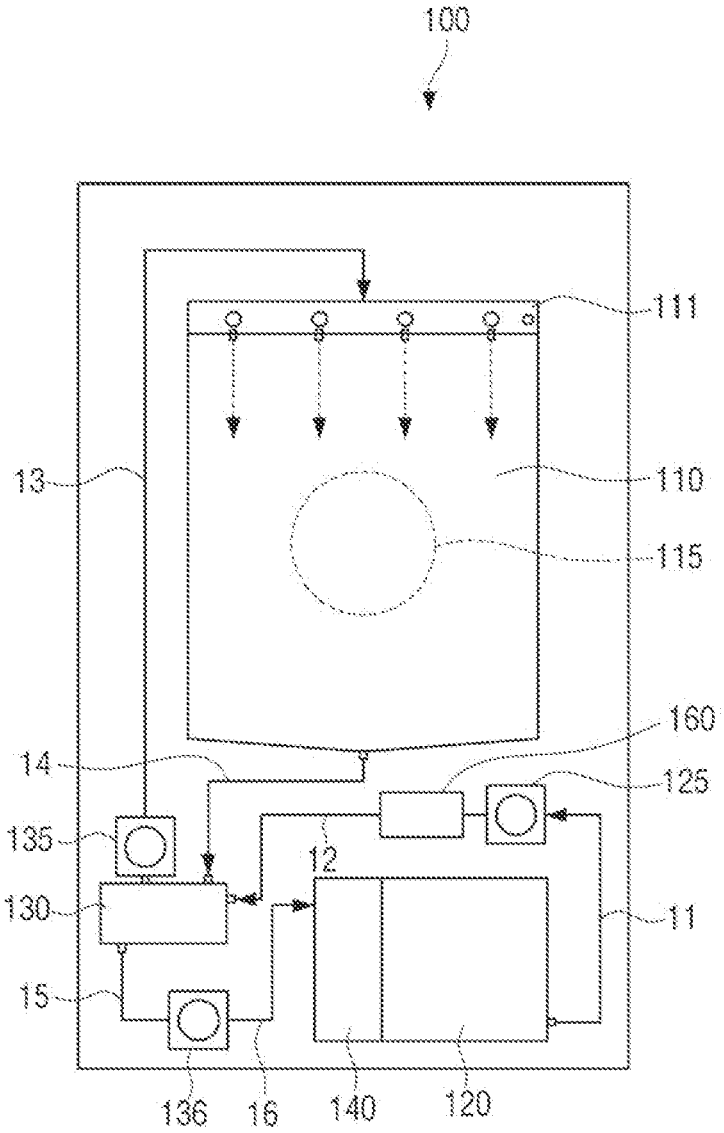
FIG. 6 is a view illustrating a configuration of a humidifier including a filter according to an embodiment of the disclosure.

FIG. 6 is a view illustrating a configuration of a humidifier including a filter according to an embodiment of the disclosure.

Referring to FIG. 6, the humidifier 100 may further include a filter 160 in addition to the components of FIG. 1.

The filter 160 is a component for purifying water supplied from the storage water tank 120 to the circulating water tank 130. The filter 160 may be replaced as a result of being formed in a detachable structure to the humidifier 100.

The filter 160 may remove sludge, bacteria, etc. in water. For example, the filter 160 may include at least one of an ultra-filtration membrane filter, a sediment filter, and an activated carbon filter, but is not limited thereto.

When the water level in the circulating water tank 130 is less than a predetermined low water level, the controller 150 of FIG. 6 may control the supply pump 125 such that the water accommodated in the storage water tank 120 passes through the filter 160 and is supplied to the circulating water tank 130.

In this case, the controller 150 may identify whether the filter 160 needs to be replaced based on a time it takes for the water level in the circulating water tank 130 to reach a predetermined high water level, and may provide a notification related to the replacement of the filter 160 as a result of the identification.

For example, when the time it takes for the water level in the circulating water tank 130 to reach the predetermined high water level is more than the predetermined time, the controller 150 may identify that the filter 160 needs to be replaced, and provide a notification that the filter 160 needs to be replaced. In this case, the controller 150 may stop the humidity mode.

The predetermined time may be a time required to fill a predetermined high water level in the circulating water tank 130 according to a flow rate of the filter 160 clogged by 70 to 80% compared to the filter 160 in the initial state, but is not limited thereto.

Meanwhile, the controller 150 may identify the time taken for the water level in the circulating water tank 130 to reach the predetermined high water level and store the time in a memory, or the like, each time the supply pump 125 supplies the water accommodated in the storage water tank 120 to the circulating water tank 130.

And, based on a changing pattern of the time stored before the time when it is identified that the filter needs to be replaced (depending on the time taken for the water level in the circulating water tank 130 to reach the high water level), the control unit 150 may identify the number of water supply of the supply pump 125 is supplied with water that requires replacement of the filter.

Thereafter, the controller 150 may identify whether the filter needs to be replaced based on the identified number of water supply, without measuring the time it takes for the water level in the circulating water tank 130 to reach the high water level each time.

Figure 7:
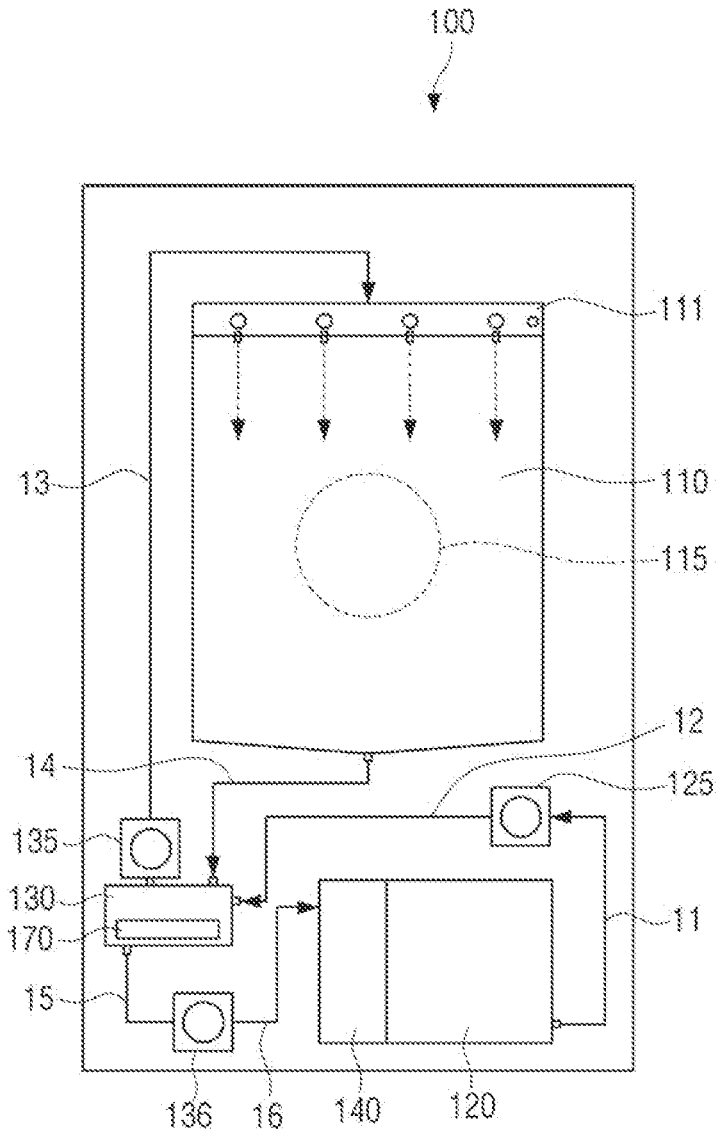
FIG. 7 is a view illustrating a configuration of a humidifier including a sterilization treatment unit according to an embodiment of the disclosure.

FIG. 7 is a view illustrating a configuration of a humidifier including a sterilization treatment unit according to an embodiment of the disclosure.

Referring to FIG. 7, the humidifier 100 may further include a sterilization treatment unit 170 in addition to the components of FIG. 1.

The sterilization treatment unit 170 is a configuration for sterilizing the water in the circulating water tank 130.

The controller 150 of the humidifier 100 of FIG. 7 may control the sterilization treatment unit 130 to sterilize water accommodated in the circulating water tank 130 when the water level in the circulating water tank 139 is more than a predetermined high water level, while the operating mode of the humidifier 100 is humidity mode. In addition, the controller 150 may control the circulating pump 135 to supply the sterilized water to the humidifying member 110.

As a result, it is possible to prevent water in which microorganisms/bacteria have propagated from being circulated through the circulating water tank 130, the humidifying member 110, or the like.

Figure 8:
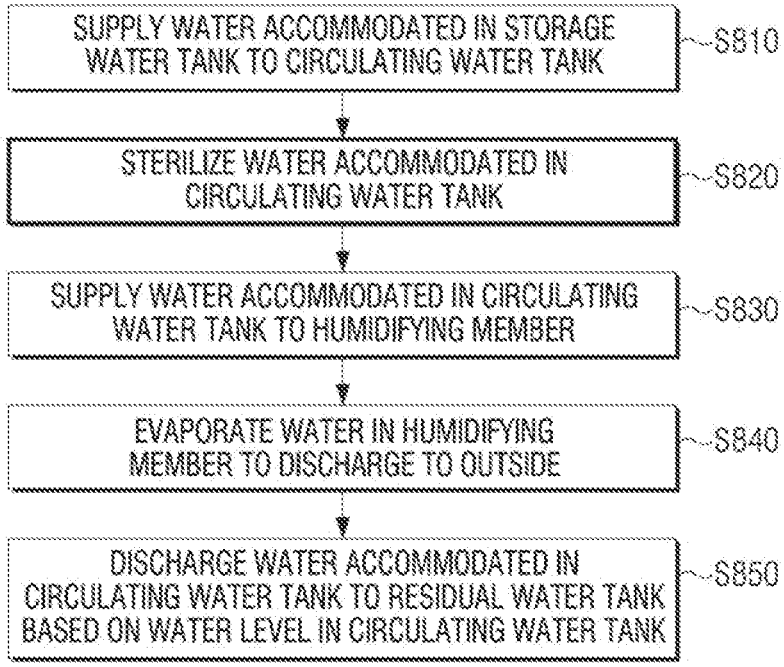
FIG. 8 is a flowchart illustrating an operation of a humidifier that performs sterilization in humidity mode.

FIG. 8 is a flowchart illustrating an operation of a humidifier that performs sterilization in humidity mode. Referring to FIG. 8, a sterilization treatment step is added in addition to the steps of FIG. 3.

Referring to FIG. 8, the controller 150 may supply water accommodated in the storage water tank to the circulating water tank (S810).

The controller 150 may control the sterilization treatment unit 170 to sterilize the water accommodated in the circulating water tank 130 (S820). Specifically, when the water level in the circulating water tank 130 is more than the predetermined high water level, the controller 150 may stop supplying water to the circulating water tank 130, while controlling the sterilization treatment unit 170 to sterilize the water accommodated in the circulating water tank 130.

In addition, the controller 150 may control the circulating pump 135 to supply the water in the sterilized circulating water tank 130 to the humidifying member 110 (S830), and control the fan 115 to discharge the water of the humidifying member 110 to the outside by vaporizing the water (S840). Meanwhile, the controller 150 may control the drainage member 136 to discharge the water accommodated in the circulating water tank 130 to the residual water tank 140 based on the water level in the circulating water tank 130 (S850).

The sterilization treatment unit 170 may be configured as a kit for performing a sterilization treatment by electrolyzing the water accommodated in the circulating water tank 130 based on an input voltage. In this case, the controller 150 may measure a current according to the voltage input to the kit through an electrode of the kit while the voltage is input to the kit.

In addition, when the measured current exceeds a first current while a first voltage is input to the kit, the controller 150 may provide a notification related to replacement of water or replenishment of water included in the circulating water tank 130. In addition, when the measured current is less than or equal to a second current while a second voltage greater than the first voltage is input to the kit, the controller 150 may provide a notification that the sterilization treatment cannot be performed through the kit.

Figure 9:
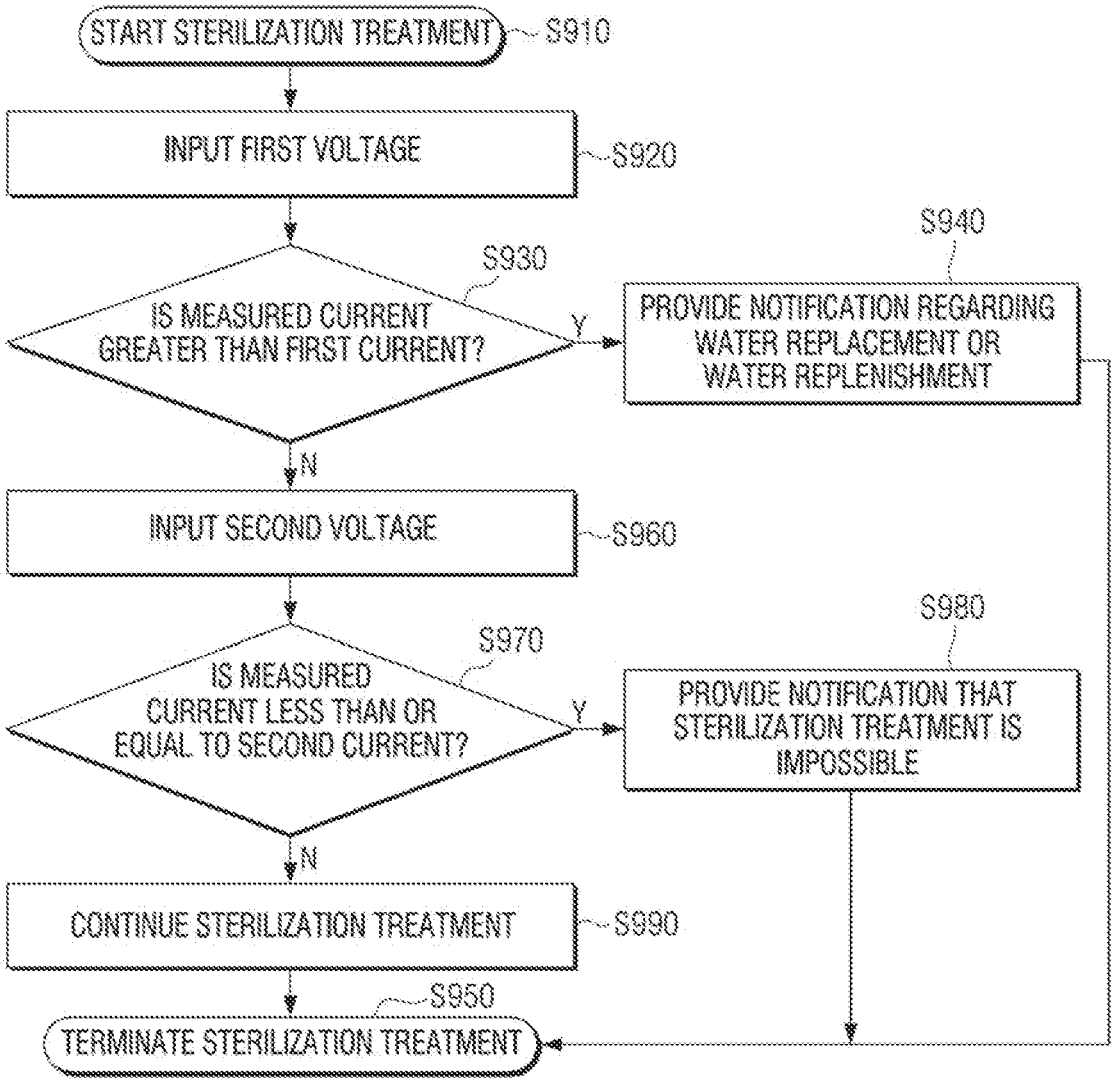
FIG. 9 is an algorithm illustrating an example of an operation of a humidifier using a kit that performs sterilization treatment based on electrolysis.

FIG. 9 is an algorithm for explaining an example of a sterilization treatment operation (S820) of a humidifier using a kit that performs sterilization treatment based on electrolysis.

FIG. 9 is an algorithm illustrating an example of a sterilization treatment operation of the humidifier using a kit that performs sterilization treatment based on electrolysis (S820).

Referring to FIG. 9, when the sterilization treatment starts (S910), the controller 150 may input a first voltage to the kit (S920). In this case, the first voltage may be DC 5.4~6.6 V.

If the measured current is greater than the first current (S930—Y), the controller 150 may identify that the water accommodated in the circulating water tank 130 is contaminated, and may provide a notification that "water replacement" or "water replenishment" is required (S940). In this case, the controller 150 may terminate the sterilization treatment (electrolysis) through the kit (S950), and may discharge the water accommodated in the circulating water tank 130 to the residual water tank 140. The first current may be a value corresponding to water having a hardness of 1200 ppm and an electrical conductivity of 1800 μm, for example, 650 mA.

Meanwhile, when the measured current is not greater than the first current (S930—N), the controller 150 may input a second voltage greater than the first voltage into the kit (S960). In this case, the second voltage may be DC 10 to 14 V.

When the measured current is less than or equal to the second current (S970—Y), the controller 150 may provide a notification that the sterilization treatment is impossible (S980). The second current may be a value corresponding to water having a hardness of 10 ppm and an electrical conductivity of 15 μm or less, for example, 50 mA. In this case, the controller 150 may stop the sterilization treatment (S950), and may provide a notification related to a "possibility of device failure" or a "necessity of water replacement".

In general, when a lead wire or a terminal configuring a kit or connected to the kit is disconnected, or when water from a reverse osmotic membrane water purifier is supplied in addition to tap water, the measured current may be less than or equal to the second current. In this case, free residual chlorine is not generated by electrolysis, so that a sterilizing effect may not occur.

Meanwhile, when the measured current exceeds the second current (S970—N), the controller 150 may continue to apply a voltage to the kit to perform the sterilization treatment normally (S990). In addition, the controller 150 may terminate the sterilization treatment after a predetermined sterilization treatment time has passed (S950).

Meanwhile, when a user command for the sterilization mode is received, the controller 150 may switch the operating mode of the humidifier 100 to the sterilization mode and perform the sterilization treatment operation. Specifically, when the water level in the storage water tank 120 is more than or equal to the predetermined low water level and the humidifying member case is mounted, the controller 150 may switch the operating mode of the humidifier 100 to the sterilization mode.

In this case, the sterilization mode may be a separate mode from the humidity mode, and may be a mode for performing a sterilization treatment in the humidifier 100. Hereinafter, an example of an operation of the humidifier that performs the sterilization treatment according to the sterilization mode will be described with reference to FIG. 10.

Figure 10:
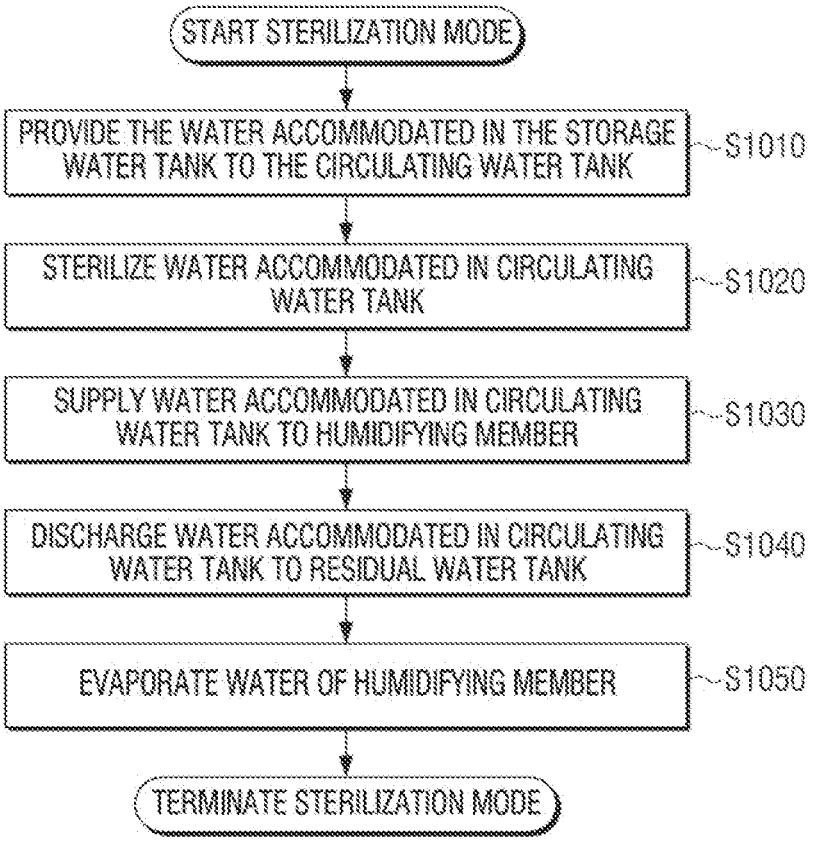
FIG. 10 is an algorithm illustrating an example of an operation of a humidifier that performs a sterilization treatment according to sterilization mode.

Referring to FIG. 10, the controller 150 may provide the water accommodated in the storage water tank 120 to the circulating water tank 130 (S1010), and control a sterilization treatment unit 170 to sterilize the water accommodated in the circulating water tank 130 (S1020).

The controller 150 may supply the sterilized water accommodated in the circulating water tank 130 to the humidifying member 110 (S1030), and discharge the water accommodated in the circulating water tank 130 depending on the water level in the circulating water tank 130 to the residual water tank 140 (S1040).

In addition, the controller 130 may control the fan 115 to evaporate water of the humidifying member 110 (S1050). For example, the controller 150 may control the fan 115 to operate for about 30 minutes, and as a result, the humidifying member 110 may be maintained in a dry state.

Meanwhile, a capacity of water corresponding to the predetermined low water level in the storage water tank 120 of the humidifier 100 according to an embodiment of the disclosure may be greater than or equal to a capacity of water corresponding to the predetermined high water level in the circulating water tank 130. As a specific example, the capacity of the water corresponding to the predetermined low water level in the storage water tank 120 may be 1 to 1.2 times the capacity of water corresponding to the predetermined high water level in the circulating water tank 130.

In this case, the controller 150 may perform the operation of FIG. 11 below.

Figure 11:
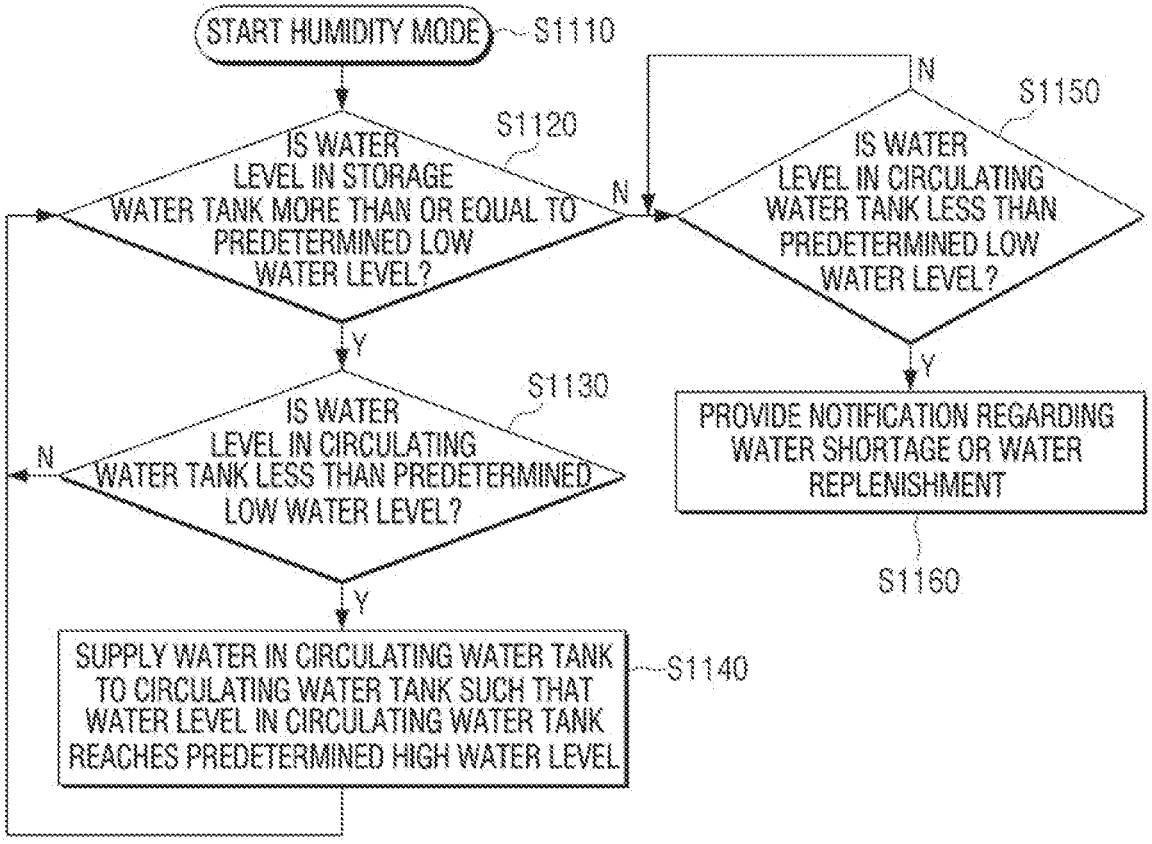
FIG. 11 is an algorithm illustrating an operation of a humidifier capable of maximizing use of water accommodated in a storage water tank according to an embodiment of the disclosure.

Referring to FIG. 11, after the humidity mode is started (S1110), when it is identified that the water level in the circulating water tank 130 is less than the water level in the predetermined low water level (an independent value different from the predetermined low water level in the storage water tank 12) (S1130—Y), while the water level in the storage water tank 120 is more than or equal to the predetermined low water level (S1120—Y), the controller 150 may control the supply pump 125 to supply the water accommodated in the storage water tank 120 such that the water level in the circulating water tank 130 reaches the predetermined high water level, to the circulating water tank 130 (S1140).

Meanwhile, when it is identified the water level in the circulating water tank 130 is less than the predetermined low water level (S1150—Y), while the water level in the storage water tank 120 is less than the predetermined low water level (S1120—N), the controller 150 may provide a notification related to water shortage/water replenishment (S1160). In this case, the controller 150 may stop the humidity mode.

In other words, through the embodiment of FIG. 11, when water is started to be supplied to the circulating water tank 130 while the water level in the storage water tank 120 is more than or equal to the predetermined low water level, even if the water level in the storage water tank 120 is less than the predetermined water level during supplying the water, the water supply to the circulating water tank 130 may be continued until the water level in the circulating water tank 130 reaches a predetermined high water level (an independent value different from the predetermined high water level in the storage water tank 12).

As a result, the "water replenishment" may be performed after the water stored in the storage water tank 120 is used to the maximum.

With respect to the embodiment of FIG. 11, when the humidity mode is stopped while the water level in the storage water tank 120 is less than the predetermined low water level, the controller 150 may control the drainage member 136 to discharge the water accommodated in the circulating water tank 130 to the residual water tank 140.

The operation of the controller 150 may be implemented slightly differently in the case when the storage water tank 120 and the residual water tank 140 are formed separately from each other, and in the case when the both tanks are formed integrally with each other.

Specifically, when the storage water tank 120 is formed separately from the residual water tank 140, the controller 150 may provide a notification that water needs to be replenished when the water level in the circulating water tank 130 is less than the predetermined low water level according to the discharge of water described above, In addition, the controller 150 may provide a notification that the water in the residual water tank needs to be discarded and/or a notification that water needs to be replenished, when the water level in the residual water tank 140 is more than or equal to the predetermined high water level according to the discharge of water described above.

Meanwhile, when the storage water tank 120 is formed integrally with the residual water tank 140, and water overflowing from the residual water tank 140 is formed to be accommodated in the storage water tank 120, the controller 150 may provide the notification that the water needs to be replenished when the water level in the circulating water tank 130 is less than the predetermined low water level according to the water discharge described above. In addition, the controller 150 may provide the notification that the water needs to be discarded and/or the notification that water needs to be replenished, when the water level in the circulating water tank 130 is less than the predetermined low water level and the water level in the residual water tank 140 is more than or equal to the predetermined high water level.

When the storage water tank 120 and the residual water tank 140 are integrally formed, even if the water in the residual water tank 140 overflows, since the overflowed water may be accommodated in an empty space of the storage water tank 120, the water is not urgent to be immediately discharged. In other words, water discarding and water replacement may be simultaneously performed by the user.

Meanwhile, as described through the various embodiments described above, the humidity mode may be stopped for various reasons such as when the water level in the storage water tank 120 is less than the predetermined water level, when a water filter needs to be replaced, when sterilization treatment (ex. electrolysis) is impossible, when the low water level in the circulating water tank is detected, or the like.

After the humidity mode is stopped for various reasons as described above, the controller 150 may control the drainage member 136 to discharge the water accommodated in the circulating water tank 130 to the residual water tank 140. The controller 150 may discharge the water accommodated in the circulating water tank 130 immediately after the humidity mode is stopped, or discharge the water accommodated in the circulating water tank 130 after a certain time (ex. 10 minutes) passes after the humidity mode is stopped As a result, while the humidifying operation is not performed, it may prevent residual water in the circulating water tank 130 from being left in the circulating water tank 130.

Figure 12A:
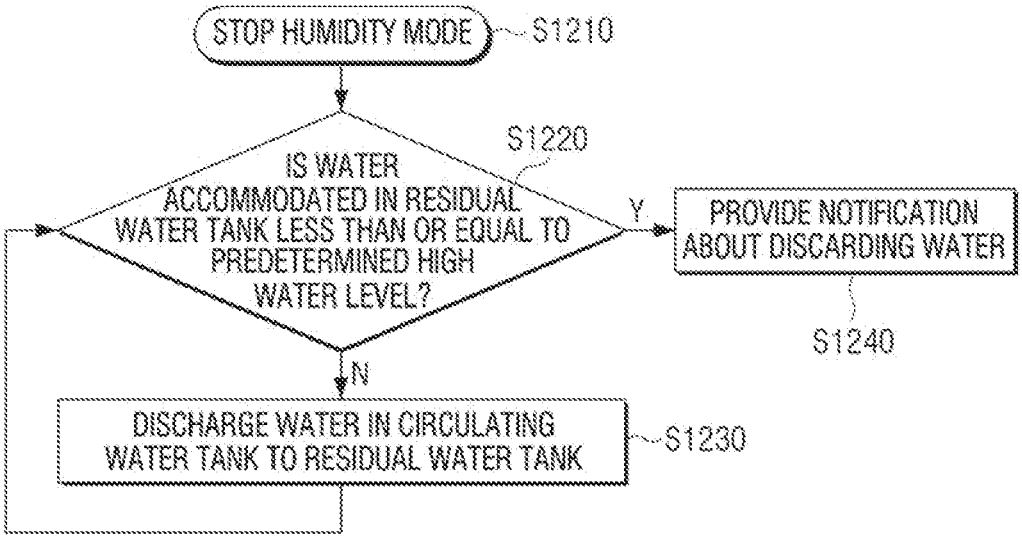
FIGS. 12A and 12B are algorithms illustrating an operation of a humidifier after humidity mode is stopped with respect to a storage water tank and a residual water tank are of a separate type and an integrated type.
Figure 12B:
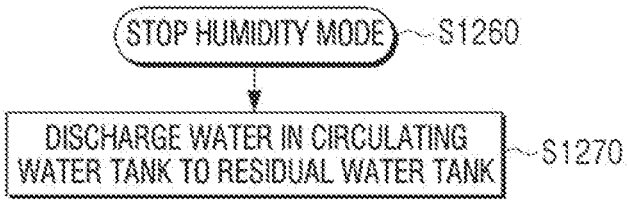

FIGS. 12A and 12B are algorithms illustrating an operation of a humidifier after humidity mode is stopped with respect to a storage water tank and a residual water tank are of a separate type and an integrated type.

FIG. 12A assumes that the storage water tank 120 is formed separately from the residual water tank 140.

Referring to FIG. 12A, when the humidity mode is stopped (1210), the controller 150 may discharge the water accommodated in the circulating water tank 130 to the residual water tank 140 (S1230) while the water accommodated in the residual water tank 140 is less than or equal to the predetermined high water level (S1220—N).

In this case, the controller 150 may discharge the water until the water level in the circulating water tank 140 reaches a predetermined ultra-low water level. In other words, the controller 150 may control the drainage member 136 to discharge the water accommodated in the circulating water tank 130 to the residual water tank 140 until the water level in the residual water tank 140 reaches the predetermined high water level or the water level in the circulation tank reaches the predetermined low water level.

However, when the water level in the residual water tank 140 becomes more than or equal to the predetermined high water level due to water discharge (S1220—Y), the controller 150 may provide a notification about the discarding of water in the residual water tank 140 (S1240). In this case, the discharge of the water accommodated in the circulating water tank 130 to the residual water tank 140 may be stopped.

FIG. 12B assumes that the storage water tank 120 is formed integrally with the residual water tank 140, and water overflowing from the residual water tank 140 is formed to be accommodated in the storage water tank 120.

Referring to FIG. 12B, when the humidity mode is stopped (S1260), the controller 150 may discharge the water accommodated in the circulating water tank 130 to the residual water tank 140 regardless of the water level in the residual water tank 140 (S1270).

In other words, the controller 150 may control the drainage member 136 to discharge the water accommodated in the circulating water tank 130 to the residual water tank 140 until the water level in the circulation tank reaches a predetermined low water level, regardless of the water level in the residual water tank 140.

Meanwhile, after the humidity mode is stopped, if it is identified that the water level in the storage water tank 120 is less than the predetermined low water level, the controller 150 may provide a notification that water replenishment is required.

Alternatively, after the humidity mode is stopped, when the water level in the storage water tank 120 is less than the predetermined low water level and the water level in the circulating water tank 130 is less than the predetermined low water level, the controller 150 may provide the notification that water replenishment is required.

Meanwhile, the various embodiments shown and described through the drawings illustrated above may be independently/selectively applied to the humidifier 100. In other words, the humidifier 100 to which at least two of the embodiments described above are applied is also included in the technical idea of the disclosure.

Figure 13:
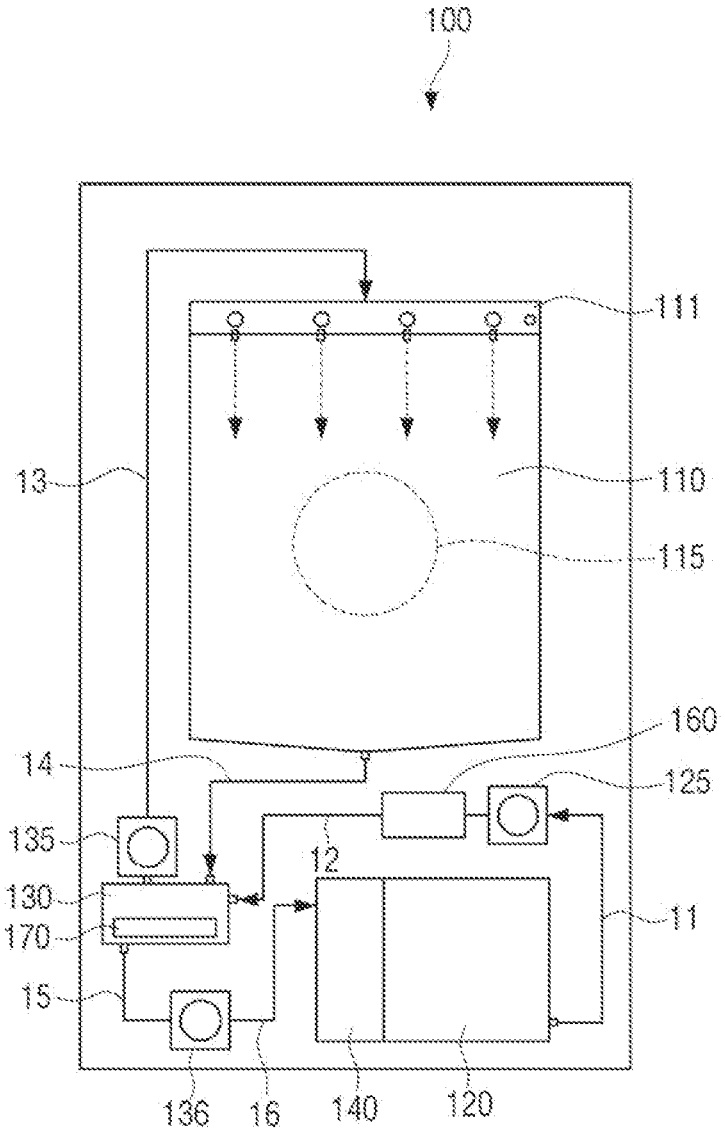
FIG. 13 is a view illustrating a detailed configuration of a humidifier according to various embodiments of the disclosure.

FIG. 13 is a view illustrating a detailed configuration of a humidifier according to various embodiments of the disclosure. Referring to FIG. 13, the humidifier 100 may further include at least one of a filter 160 and a sterilization treatment unit 170 in addition to the components of FIG. 1.

Figure 14:
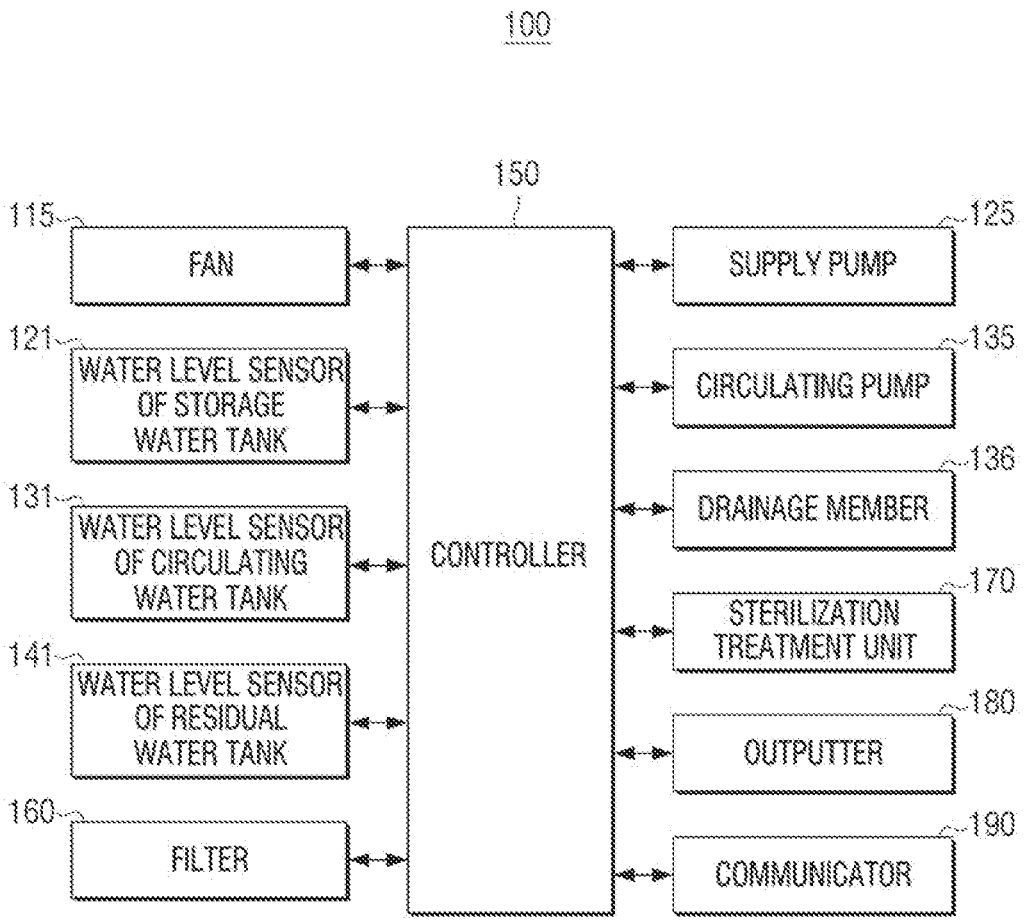
FIG. 14 is a block diagram functionally illustrating a configuration of a humidifier according to various embodiments of the disclosure.

FIG. 14 is a block diagram functionally illustrating a configuration of a humidifier according to various embodiments of the disclosure.

Referring to FIG. 14, the humidifier 100 may further include a filter 160, a sterilization processing unit 170, an outputter 180, a communicator 190 or the like, in addition to the components of FIG. 2.

The outputter 180 is a component for providing a notification to the user. The controller 150 may provide various "notifications" provided through the various embodiments described above through the outputter 180.

In addition, the controller 150 may control the outputter 180 to provide information on the operating mode of the humidifier 100. For example, when the humidity mode is started, a notification that the humidity mode is currently being performed may be provided through the outputter 180.

For this operation, the outputter 80 may include a display, a speaker, or the like.

The communicator 190 is a configuration for performing communication with at least one external apparatus. The communicator 190 may be implemented in various forms such as a Bluetooth module, a Wi-Fi module, an LTE module, a 4G/5G module, an infrared communication module, or the like.

As an example, the controller 150 may transmit information on a notification related to "discarding water" or "replacement of water" to a user terminal device (e.g., a smartphone). In this case, the user terminal device may provide the corresponding notification to the user.

For example, the controller 150 may transmit information on a current operating mode of the humidifier 100 to the user terminal device.

In addition, information on a user command input to the user terminal device may be transmitted to the humidifier 100 through the communicator 190. In this case, the controller 150 may start/terminate the humidity mode/sterilization mode, etc. according to a user command.

Meanwhile, although not shown through FIG. 14, the humidifier 100 may additionally include a user inputter for receiving a user command. The user inputter may be implemented as a microphone, a touch screen, a motion sensor, a button, or the like, but is not limited thereto.

As an example, when a user command is received to the humidifier 100 through the user inputter, the controller 150 may start/terminate the humidity mode/sterilization mode, etc. according to the user command.

Various exemplary embodiments described above may be embodied in a recording medium that may be read by a computer or a similar apparatus to the computer by using software, hardware, or a combination thereof.

According to the hardware embodiment, exemplary embodiments that are described in the present disclosure may be embodied by using at least one selected from Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, electrical units for performing other functions.

In some cases, the embodiments described herein may be implemented by the processor itself. In a software configuration, various embodiments described in the specification such as a procedure and a function may be embodied as separate software modules. The software modules may respectively perform one or more functions and operations described in the present specification.

Meanwhile, computer instructions for performing a processing operation in the humidifier 100 according to various embodiments of the disclosure described above may be stored in a non-transitory computer-readable medium. The computer instructions stored in the non-transitory computer-readable medium may allow specific devices described above to perform the processing operation of the humidifier 100 according to various embodiments of the disclosure when executed by the processor of the specific device.

The non-transitory computer readable recording medium refers to a medium that stores data and that can be read by devices. In detail, the above-described various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

The foregoing exemplary embodiments and advantages are merely exemplary and are not to be construed as limiting the present invention. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A humidifier comprising:

a storage water tank to store water;

a circulating water tank to receive and store water from the storage water tank;

a residual water tank to receive and store water from the circulating water tank;

a supply pump configured to supply water stored in the storage water tank to the circulating water tank while the humidifier operates in a humidity mode;

a humidifying member to receive water stored in the circulating water tank while the humidifier operates in the humidity mode;

a circulating pump configured to supply the water in the circulating water tank to the humidifying member while the humidifier operates in the humidity mode;

a fan configured to blow air toward the humidifying member which has received the water from the circulating water tank to evaporate the water received by the humidifying member and thereby cause water evaporated to be discharged to outside the humidifier while the humidifier operates in a humidity mode;

an internal pipe configured to form a flow pass through which water that remains in the humidifying member is guided to the circulating water tank;

a drainage member configured to selectively discharge the water in the circulating water tank to the residual water tank; and a controller configured to control the drainage member to discharge the water in the circulating water tank to the residual water tank based on the humidity mode being stopped.

2. The humidifier of claim 1, wherein the storage water tank is formed separately from the residual water tank, and the controller is configured to control the drainage member to stop the discharge based on a water level in the residual water tank reaching a predetermined high water level by the water discharge, or a water level in the circulating water tank reaching a predetermined low water level by the water discharge after the humidity mode is stopped.

3. The humidifier of claim 1, wherein the storage water tank is formed integrally with the residual water tank, and is formed such that water overflowing from the residual water tank is accommodated in the storage water tank, and the controller is configured to control the drainage member to stop the discharge based on the water level in the circulating water tank reaching the predetermined low water level by the discharge after the humidity mode is stopped.

4. The humidifier of claim 1, wherein the storage water tank is formed separately from the residual water tank, and the controller is configured to control the drainage member to discharge the water in the circulating water tank to the residual water tank based on the humidity mode being stopped while the water level in the storage water tank is less than the predetermined low water level, provide a notification that water needs to be replenished based on the water level in the circulating water tank being less than the predetermined low water level according to the water discharge, and provide a notification that water in the residual water tank needs to be discarded based on the water level in the residual water tank being greater than or equal to the predetermined high water level according to the water discharge.

5. The humidifier of claim 1, wherein the storage water tank is formed integrally with the residual water tank, and is formed such that water overflowing from the residual water tank is accommodated in the storage water tank, wherein the controller is configured to control the drainage member to discharge the water in the circulating water tank to the residual water tank based on the humidity mode being stopped while the water level in the storage water tank is less than the predetermined low water level, provide the notification water needs to be replenished based on the water level in the circulating water tank being less than the predetermined low water level according to the water discharge, and provide the notification water in the residual water tank needs to be discarded based on the water level in the circulating water tank being less than the predetermined low water level, and the water level in the residual water tank being greater than or equal to the predetermined high water level according to the water discharge.

6. The humidifier of claim 1, further comprising:

a circulating pipe connected between the circulating water tank and the humidifying member.

* * * * *